US008182170B1

(12) United States Patent
Blanton

(10) Patent No.: US 8,182,170 B1
(45) Date of Patent: May 22, 2012

(54) FLUID LINE INDICATOR SYSTEM

(76) Inventor: Arlis Blanton, Sanford, FL (US)

( * ) Notice: Subject to any disclaimer, the term of this patent is extended or adjusted under 35 U.S.C. 154(b) by 207 days.

(21) Appl. No.: 12/719,065

(22) Filed: Mar. 8, 2010

(51) Int. Cl.
*E01F 9/053* (2006.01)

(52) U.S. Cl. ..... 404/7; 404/16

(58) Field of Classification Search ..... 404/2, 7, 404/15, 16; 116/63 R
See application file for complete search history.

(56) References Cited

U.S. PATENT DOCUMENTS

| | | | | |
|---|---|---|---|---|
| 355,810 | A * | 1/1887 | Brown | 404/7 |
| 1,479,651 | A * | 1/1924 | Clements | 404/6 |
| 1,816,502 | A * | 7/1931 | Theel | 404/15 |
| 1,886,721 | A * | 11/1932 | O'Brien | 404/10 |
| 2,015,031 | A * | 9/1935 | Fischer | 404/15 |
| 2,304,345 | A * | 12/1942 | Elliott | 404/15 |
| 2,354,857 | A * | 8/1944 | Gits et al. | 40/616 |
| 3,851,615 | A | 12/1974 | Grundvig et al. | |
| 3,901,614 | A | 8/1975 | Overacker | |
| 4,441,288 | A | 4/1984 | Feldman et al. | |
| D339,080 | S | 9/1993 | Gartlacher | |
| 6,558,011 | B2 | 5/2003 | Fritz | |
| 7,025,527 | B2 | 4/2006 | Mecham | |
| 7,249,911 | B2 * | 7/2007 | Hyams | 404/15 |
| 7,401,997 | B1 * | 7/2008 | Chen | 404/11 |
| 2005/0008434 | A1 * | 1/2005 | Chen | 404/16 |
| 2007/0201948 | A1 * | 8/2007 | Harward et al. | 404/15 |

* cited by examiner

*Primary Examiner* — Gary S Hartmann

(57) ABSTRACT

A fluid line indicator system includes a roadway that has a lateral edge. A curb is positioned adjacent to and extends along the lateral edge. The curb has an upper surface. A disc has a top side, a bottom side and a perimeter edge. A post is attached to and extending downwardly from a central area of the bottom side. The post is imbedded into the upper surface and the disc is imbedded into the curb. A panel is mounted on the disc and completely covers the top side, the panel comprising a reflector. The post is positioned in an area adjacent to a fluid access point to indicate placement of the fluid access point.

6 Claims, 3 Drawing Sheets

FLUID LINE INDICATOR SYSTEM

BACKGROUND OF THE DISCLOSURE

Field of the Disclosure

The disclosure relates to conduit locating devices and more particularly pertains to a new conduit locating device for assisting a person in quickly determining the access points for buried conduits.

SUMMARY OF THE DISCLOSURE

An embodiment of the disclosure meets the needs presented above by generally comprising a roadway that has a lateral edge. A curb is positioned adjacent to and extends along the lateral edge. The curb has an upper surface. A disc has a top side, a bottom side and a perimeter edge. A post is attached to and extending downwardly from a central area of the bottom side. The post is imbedded into the upper surface and the disc is imbedded into the curb. A panel is mounted on the disc and completely covers the top side, the panel comprising a reflector. The post is positioned in an area adjacent to a fluid access point to indicate placement of the fluid access point.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
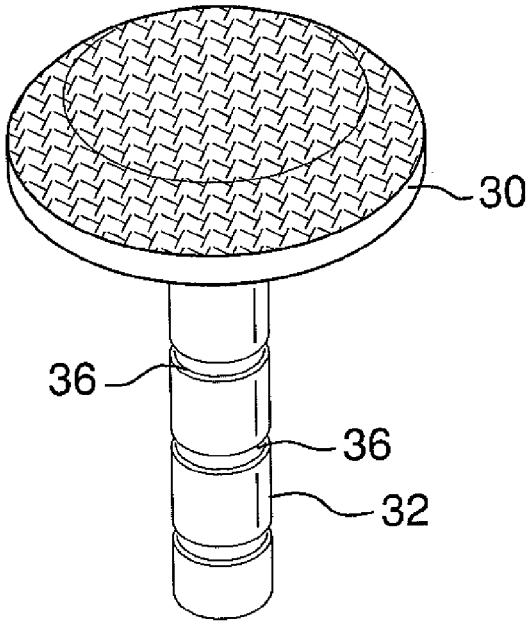
FIG. 1 is a top perspective view of a fluid line indicator system according to an embodiment of the disclosure.
Figure 2:
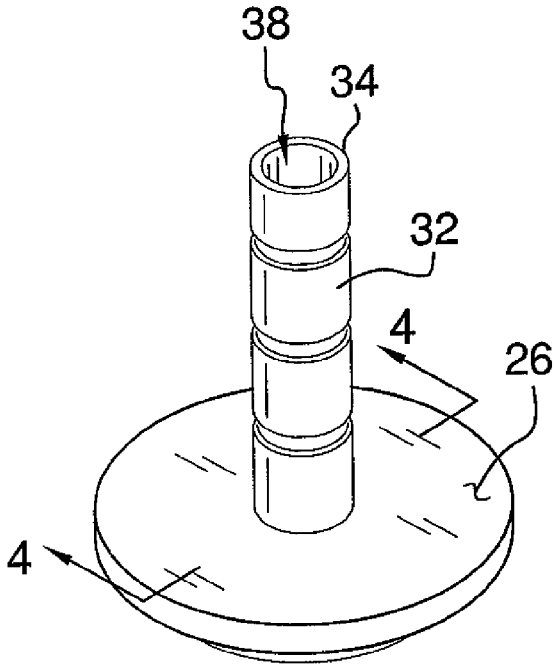
FIG. 2 is a bottom perspective view of an embodiment of the disclosure.
Figure 3:
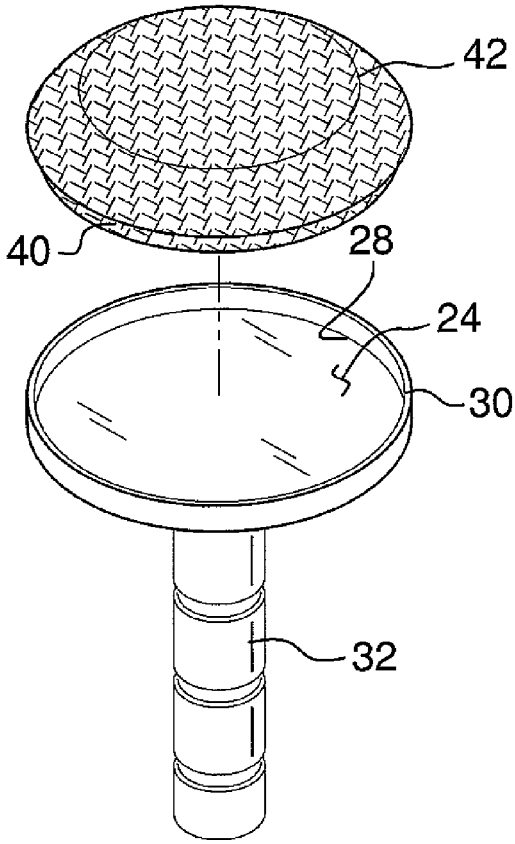
FIG. 3 is an exploded perspective view of an embodiment of the disclosure.
Figure 4:
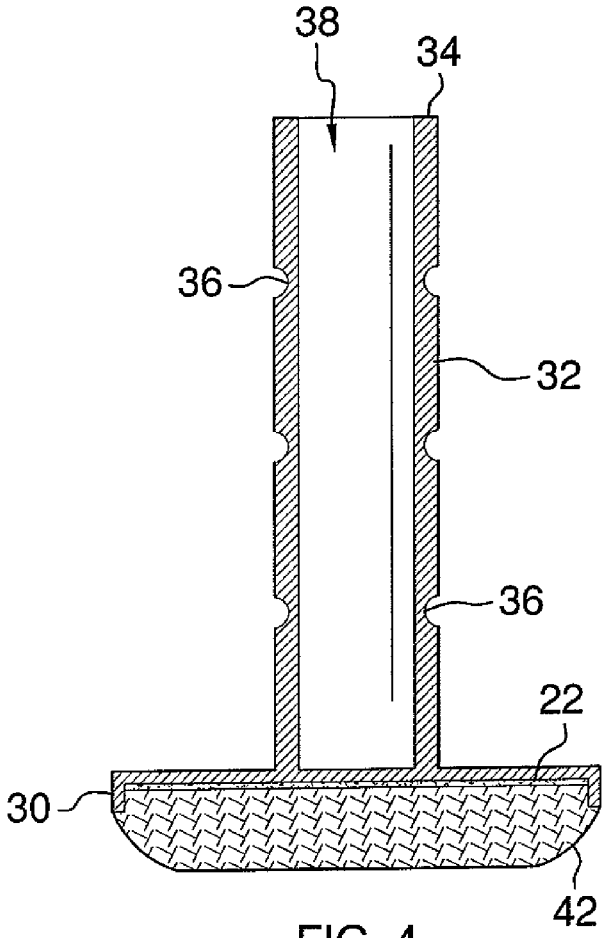
FIG. 4 is a cross-sectional view of an embodiment of the disclosure.
Figure 5:
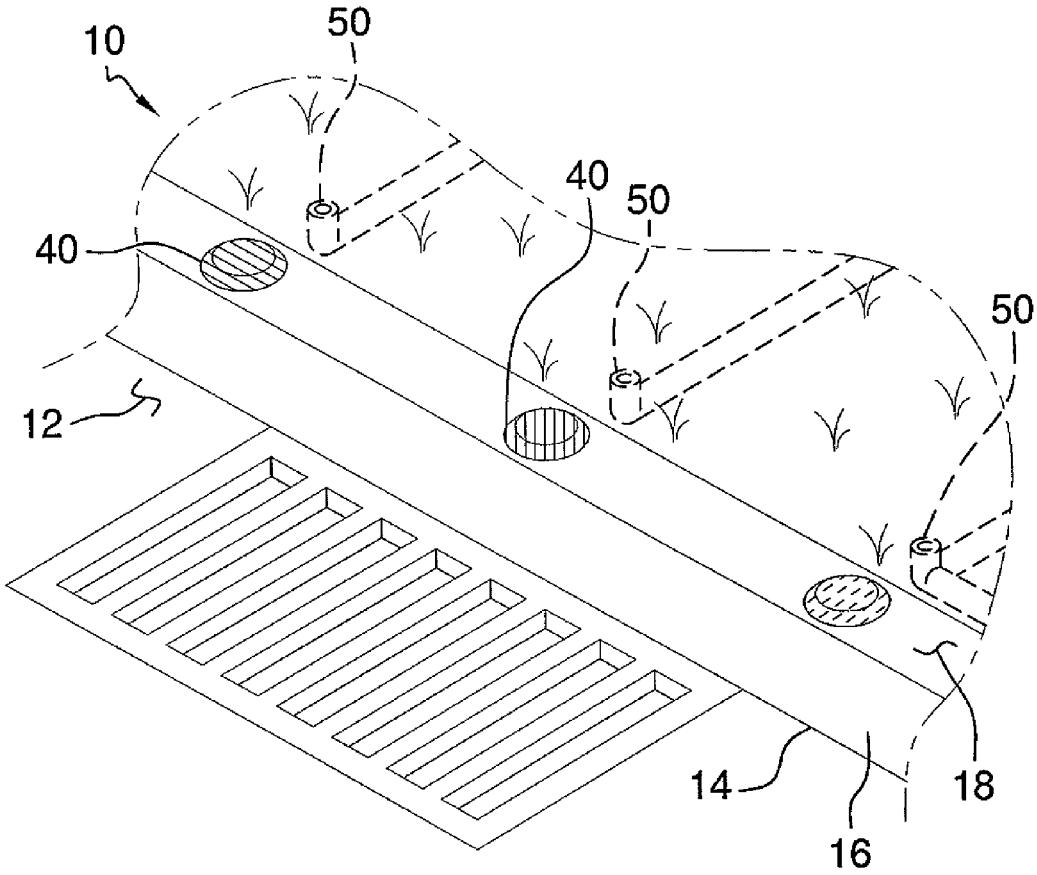
FIG. 5 is a top perspective view of an embodiment of the disclosure.

With reference now to the drawings, and in particular to FIGS. 1 through 5 thereof, a new conduit locating device embodying the principles and concepts of an embodiment of the disclosure and generally designated by the reference numeral 10 will be described.

As best illustrated in FIGS. 1 through 5, the fluid line indicator system 10 generally comprises a roadway 12 that has a lateral edge 14. A curb 16 is positioned adjacent to and extends along the lateral edge 14. The curb 16 has an upper surface 18.

A disc 22 has a top side 24, a bottom side 26 and a perimeter edge 28. An upwardly extending peripheral flange 30 is attached to the top side 24 and is coextensive with the perimeter edge 28. The peripheral flange 30 has height approximately equal to ⅛ inch and the top side 24 has a diameter approximately equal to 1½ inches.

A post 32 is attached to and extends downwardly from a central area of the bottom side 26. The post 32 is imbedded into the upper surface 18 and the disc 22 is imbedded into the curb 16. The post 32 has a free end 34 that is distal to the disc 22. The post 32 has a height from the disc 22 to the free end 34 between 1½ inches and 3 inches and a width between ⅜ inch and ¾ inch. The post 32 has a plurality of annular slots 36 therein. A bore 38 extends upwardly into the distal end of the post. The post 32 and the disc 22 are each comprised of brass. The slots 25 and bore 38 help to engage wet cement when the post 32 is extended into the curb 16.

A panel 40 is mounted on the disc and completely covers the top side 24. The panel 40 comprises a reflector. The panel 40 has an upper portion 42 having a frusto-conical shape extending upwardly above the peripheral flange 30. The panel 40 may be colored though it may also be clear. The color used may depend on the type of fluid conduit access point 50 being indicated. For that reason, red, blue, clear, green, etc. may be used.

In use, the post 32 (or posts) is positioned in an area adjacent to a fluid access point 50 to indicate placement of the fluid access point 50. Examples of the fluid access point 50 may include a water valve, a release valve or a sanitary clean out. The panel 42 is light reflective and therefore highly visible to prevent the need of lengthy searches for these conduits which are otherwise not marked.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An indicator system for indicating the placement of fluid conduit access points, said system including:

a roadway having a lateral edge;

a curb being positioned adjacent to and extending along said lateral edge, said curb having an upper surface;

a disc having a top side, a bottom side and a perimeter edge;

a post being attached to and extending downwardly from a central area of said bottom side, said post being imbedded into said upper surface and said disc being imbedded into said curb;

a panel being mounted on said disc and completely covering said top side, said panel comprising a reflector;

an upwardly extending peripheral flange being attached to said top side and being coextensive with said perimeter edge; and wherein said post is positioned in an area adjacent to a fluid access point to indicate placement of the fluid access point.

2. The system according to claim 1, wherein said post has a free end being distal to said disc, said post having a height from said disc to said free end between 1½ inches and 3 inches and a width between ⅜ inch and ¾ inch.

3. The system according to claim 1, wherein said post has a plurality of annular slots therein.

4. The system according to claim 3, wherein a bore extends upwardly into said distal end of said post.

5. The system according to claim 1, said panel having an upper portion having a frusto-conical shape extending upwardly above said peripheral flange.

6. An indicator system for indicating the placement of fluid conduit access points, said system including:

a roadway having a lateral edge;

a curb being positioned adjacent to and extending along said lateral edge, said curb having an upper surface;

a disc having a top side, a bottom side and a perimeter edge, an upwardly extending peripheral flange being attached to said top side and being coextensive with said perimeter edge, said peripheral flange having height approximately equal to ⅛ inch, said top side having a diameter approximately equal to 1½ inches;

a post being attached to and extending downwardly from a central area of said bottom side, said post being imbedded into said upper surface and said disc being imbedded into said curb, said post having a free end being distal to said disc, said post having a height from said disc to said free end between 1½ inches and 3 inches and a width between ⅜ inch and ¾ inch, said post having a plurality of annular slots therein, a bore extending upwardly into said distal end of said post, said post and said disc each being comprised of brass;

a panel being mounted on said disc and completely covering said top side, said panel comprising a reflector, said panel having an upper portion having a frusto-conical shape extending upwardly above said peripheral flange, said panel being colored; and wherein said post is positioned in an area adjacent to a fluid access point to indicate placement of the fluid access point.

* * * * *